US009498660B2

(12) United States Patent
Moine et al.

(10) Patent No.: US 9,498,660 B2
(45) Date of Patent: Nov. 22, 2016

(54) FALL ARREST SAFETY APPARATUS ON A ROPE WITH CLAMPING FUNCTION

(71) Applicant: ZEDEL, Crolles (FR)

(72) Inventors: Julien Moine, La Terrasse (FR); Michael Chaumontet, Crolles (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 14/154,921

(22) Filed: Jan. 14, 2014

(65) Prior Publication Data

US 2014/0196985 A1 Jul. 17, 2014

(30) Foreign Application Priority Data

Jan. 15, 2013 (FR) ..... 13 00076

(51) Int. Cl.

*A62B 35/00* (2006.01)
*A62B 1/14* (2006.01)
*A63B 29/02* (2006.01)

(52) U.S. Cl.

CPC ..... *A62B 35/0081* (2013.01); *A62B 1/14* (2013.01); *A63B 29/02* (2013.01)

(58) Field of Classification Search

CPC ..... A62B 1/14; A62B 35/0081
See application file for complete search history.

(56) References Cited

U.S. PATENT DOCUMENTS

| | | | | |
|---|---|---|---|---|
| 3,638,713 | A | 2/1972 | Knell et al. | |
| 4,034,828 | A | 7/1977 | Rose et al. | |
| 4,546,851 | A | 10/1985 | Brennan | |
| 4,560,029 | A | 12/1985 | Dalmaso | |
| 4,657,110 | A | 4/1987 | Wolner | |
| 4,923,037 | A | 5/1990 | Stephenson et al. | |
| 5,156,240 | A | 10/1992 | Ostrobrod | |
| 5,265,696 | A | 11/1993 | Casebolt | |
| 5,638,919 | A | 6/1997 | Pejout | |
| 5,664,640 | A | 9/1997 | Smith | |
| 5,845,894 | A | 12/1998 | Petzl et al. | |
| 5,855,251 | A | 1/1999 | Deuer | |
| 6,056,086 | A | 5/2000 | Gortan et al. | |
| 6,694,922 | B2 * | 2/2004 | Walter et al. | 119/772 |
| 6,793,046 | B2 | 9/2004 | Petzl et al. | |
| 7,036,459 | B1 * | 5/2006 | Mugford et al. | 119/796 |
| 7,137,481 | B2 | 11/2006 | Petzl et al. | |

(Continued)

FOREIGN PATENT DOCUMENTS

| | | |
|---|---|---|
| EP | 1 380 320 A1 | 1/2004 |
| EP | 1 525 903 A1 | 4/2005 |

(Continued)

OTHER PUBLICATIONS

U.S. Appl. No. 14/154,426, filed Jan. 14, 2014 in the name of Moine et al.
Jul. 30, 2015 Office Action issued in U.S. Appl. No. 14/154,426.

*Primary Examiner* — Alvin Chin-Shue
(74) *Attorney, Agent, or Firm* — Oliff PLC

(57) ABSTRACT

A fall arrest safety apparatus on a rope includes a rotary roller mounted on a pivoting arm with speed detection, and a control selector of a ratchet. The latter is able to occupy a released inactive position enabling the roller to rotate in both directions of rotation in a first fall arrest operating mode, and an active position with unidirectional blocking of the roller in rotation with respect to the arm in the descending direction corresponding to a second operating mode of the apparatus as a simple clamp.

9 Claims, 4 Drawing Sheets

(56) References Cited

U.S. PATENT DOCUMENTS

| | | | | |
|---|---|---|---|---|
| 8,225,905 | B2 | 7/2012 | Delaittre et al. | |
| 2004/0020727 | A1 | 2/2004 | Petzl et al. | |
| 2005/0082115 | A1 | 4/2005 | Petzl et al. | |
| 2007/0215411 | A1* | 9/2007 | Petzl et al. | 182/193 |
| 2008/0230015 | A1* | 9/2008 | Bleshoy | 119/796 |
| 2009/0026023 | A1* | 1/2009 | Petzl et al. | 188/65.4 |
| 2012/0193166 | A1* | 8/2012 | Rogelja | 182/5 |

FOREIGN PATENT DOCUMENTS

| | | |
|---|---|---|
| EP | 1 380 320 B1 | 5/2005 |
| EP | 2 527 009 A2 | 11/2012 |
| ES | 2 005 895 | 4/1989 |
| FR | 2 005 895 | 12/1969 |
| GB | 1271275 | 4/1972 |
| GB | 2 192 664 A | 1/1988 |
| WO | WO 98/02210 | 1/1998 |

* cited by examiner

FALL ARREST SAFETY APPARATUS ON A ROPE WITH CLAMPING FUNCTION

BACKGROUND OF THE INVENTION

The invention relates to a fall arrest safety apparatus on a rope, comprising:

- a rigid body provided with a trunking for housing the rope,
- a securing system with a rotary roller with detection of the speed of rotation, said roller being fitted on a mobile arm able to be moved between a blocking position of the rope in the event of a fall and a released position.

STATE OF THE ART

In normal use for ascending or descending, known fall arrest safety devices follow the progression of the person along the rope without causing blocking. The person is free to move without any manual releasing action of the fall arrest device. Clamping on the rope takes place only in the event of a fall.

A fall arrest device with a rotary roller is described in the documents EP 1525903 and EP 1380320. The securing system comprises an articulated support arm and a roller mounted rotating freely on the arm. A centrifugal coupling is arranged inside the roller, between a drive part of the roller and the support arm, so as to occupy a disengaged position or an engaged position according to the speed of rotation of the roller. The peripheral surface of the roller is provided with a plurality of gripping spikes, the incline of which is arranged to cause rotation of the roller in the descending direction and sliding on the rope in the ascending direction. The centrifugal coupling is in the disengaged state in normal operation for ascending or descending. Blocking takes place automatically in the case of a fall, following movement of the centrifugal coupling to the engaged state. Such a device operates only as a fall arrest safety apparatus.

For self-belaying when ascending, users normally in addition use a blocking device operating as a jamming cleat. It generally comprises a pivoting cam which jams the rope due to the effect of the user's weight. This type of blocking device described in the document FR 2 005 895 is used for ascending along a rope.

For work at height, and in caving, it is therefore necessary to have two apparatuses per user.

A fall arrest apparatus known under the trade name STICK RUN comprises a single cam with a bias spring to arrest a fall. An auxiliary lever can be actuated to add an additional force on the cam to block the rope.

Another apparatus called ROCKER concerns a fall arrest apparatus with a cam the triggering sensitivity of which is controlled by a torsion spring. An actuating part can be rotated to add an additional stress to the spring enhancing blocking.

OBJECT OF THE INVENTION

The object of the invention consists in providing a fall arrest safety apparatus with a rotary roller with speed detection, in addition having an independent blocking function.

The safety apparatus according to invention is characterized in that it comprises a control selector of a ratchet able to occupy a released inactive position enabling the roller to rotate in both directions of rotation in a first fall arrest operating mode, and an active position with unidirectional blocking of the roller in rotation with respect to said arm in the descending direction, corresponding to a second operating mode of the apparatus as a simple clamp.

The presence of the selector enables the user to choose the operating mode of the safety apparatus on a rope, either in fall arrest mode or in clamp mode for self-belaying when ascending.

According to a preferred embodiment, the ratchet is mounted swivelling around a pivot-pin and at one of its ends comprises a stop designed to engage in at least one notch of the roller in the blocking position. The notch is shaped to enable free rotation of the roller in the ascending direction in the blocked position of the ratchet.

According to one feature of the invention, a compression spring acts on the other end of the ratchet to secure the latter in stable manner in both the active and inactive positions.

The selector button is advantageously associated with transmission means operating in conjunction with a wedge forming a hang-up point when the button is in an intermediate position.

BRIEF DESCRIPTION OF THE DRAWINGS

Other advantages and features will become more clearly apparent from the following description of an embodiment of the invention given for non-restrictive example purposes only and represented in the appended drawings, in which.

DESCRIPTION OF A PARTICULAR EMBODIMENT

Figure 1:
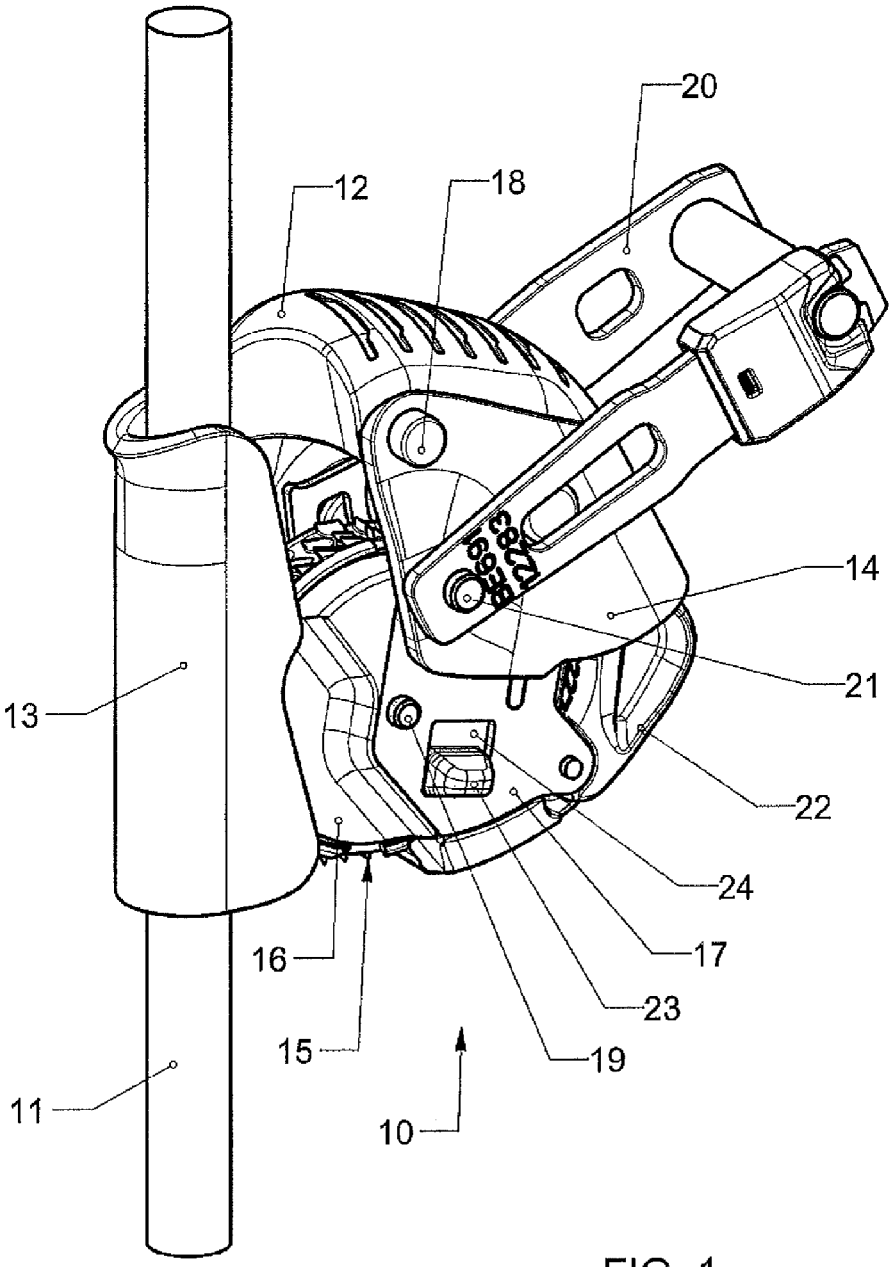
FIG. 1 is a perspective view of a fall arrest safety apparatus equipped with the selector according to the invention.
Figure 3:
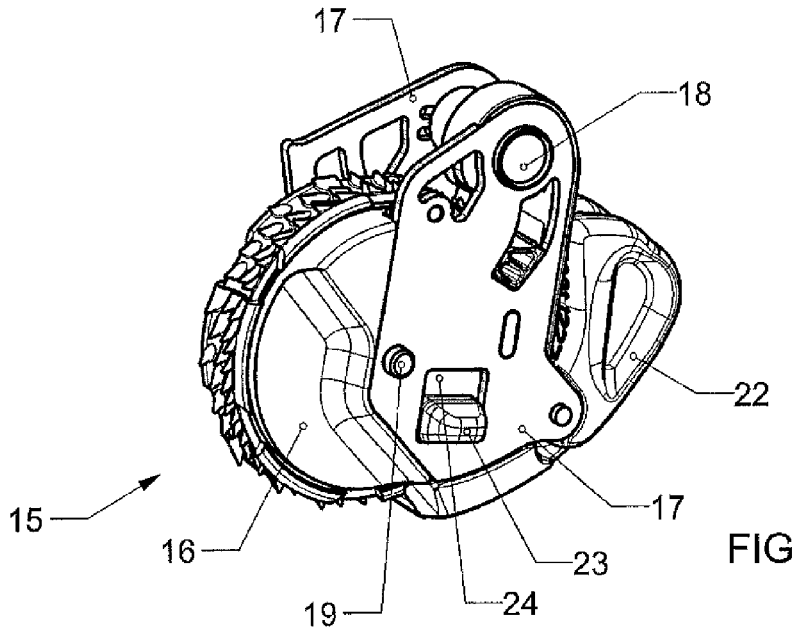
FIGS. 2 and 3 show perspective views of the securing system with roller of FIG. 1 respectively in fall arrest mode and in clamp mode.
Figure 2:
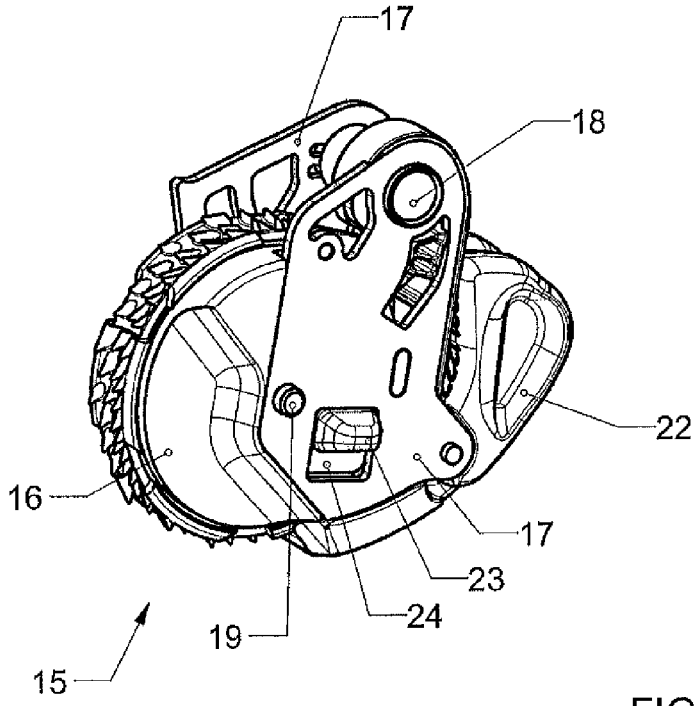

With reference to FIGS. 1 to 3, a fall arrest apparatus 10 is used for safety of a person moving along a fixed belaying rope 11. Fall arrest apparatus 10 is connected to the harness and follows the progression of the person without causing blocking in normal use for ascending or descending. The person is then free to move without any manual releasing action of fall arrest apparatus 10.

Fall arrest apparatus 10 comprises a rigid, preferably metallic, body 12 having on one side a straight trunking 13 of U-shaped cross-section for passage of rope 11, and on the other side a clamp 14 for fitting a securing system 15 with a rotary roller 16.

Securing system 15 with blocking roller 16 is able to occupy either an active blocking position in case of a fall or a released inactive position allowing progression of the person along rope 11 in the ascending direction or in the opposite direction during controlled descending. Roller 16 in the form of a cylindrical wheel is supported by a support device with a swivelling double arm 17 articulated around a first pivot-pin 18 of body 12. The peripheral surface of roller 16 is provided with inclined gripping spikes. A torsion spring (not shown) is threaded onto first pivot-pin 18 to bias roller 16 to contact with rope 11 inside trunking 13. Roller 16 is mounted rotating freely on a second pivot-pin 19 of support arms 17, and the inside of roller 16 contains a centrifugal coupling (not shown) designed to occupy a disengaged position or an engaged position according to the speed or the acceleration of blocking roller 16.

In normal use for ascending or descending, the centrifugal coupling is in the disengaged position and roller 16 follows the progression of the person without any manual releasing action of securing system 15. In case of a fall, blocking takes place automatically after the centrifugal coupling has moved to the engaged position, causing swivelling of the support arms 17 with a strong pressure of roller 16 against rope 11. The latter is pressed against the bottom of trunking 13 so as to stop the fall. Operation of such a securing system with speed detection by means of a centrifugal coupling is described for example in the documents EP 1525903 and EP 1380320.

Body 12 further comprises a rocker arm 20 having a reverse U-shape mounted rocking around a third pivot-pin 21 astride clamp 14. Rocker arm 20 is designed to be connected to the user's harness either directly by a connecting lanyard or by means of a shock absorber.

To perform installation of rope 11 in trunking 13, securing system 15 with roller 16 simply has to be moved as far as possible from trunking 13 by making the assembly formed by arms 17 and roller 16 swivel in the counterclockwise direction against the bias force of the torsion spring. A pair of cleats 22 articulated on arms 17 enable this operation to be performed.

Fall arrest apparatus 10 with roller is equipped according to the invention with a selector 23 enabling two operating modes to be chosen, either the fall arrest function with 1 speed detection described in the foregoing or a clamp function. Selector 23 is formed by a button salient from a rectangular opening 24 arranged in one of arms 17, said selector being able to be moved in translation between two stable positions, one raised (FIG. 2) corresponding to fall arrest mode and the other lowered (FIG. 3) relative to clamp mode.

With reference to FIGS. 4 to 8, selector 23 is provided with transmission means 25 designed to collaborate with a ratchet 26 which is mounted with limited pivoting around a fourth pivot-pin 27 between two stable angular positions. The periphery of roller 16 is provided with a plurality of notches 28 arranged at regular angular intervals on the two opposite annular edges. At one of the ends, ratchet 26 comprises a stop 30 having a reverse U-shape and designed to engage in two opposite notches 28 of roller 16 to block rotation of the latter in the descending direction. Due to the fact that roller 16 is fitted on pivoting arms 17, rotation of roller 16 with respect to arms 17 is blocked.

Notches 28, for example six in number on each side, are shaped so as to enable free rotation of roller 16 in the ascending direction. A compression spring 29 acts permanently on the other end of ratchet 26.

The reaction of spring 29 on ratchet 26 makes it possible not to be hyperstatic when switching to clamp mode (FIG. 4), whereas U-shaped stop 30 of ratchet 26 is not facing notches 28 of roller 16. Ratchet 26 is then pressing on the outside of roller 16 until roller 16 rotates sufficiently enabling stop 30 of ratchet 26 to fall into notches 28.

Figure 4:
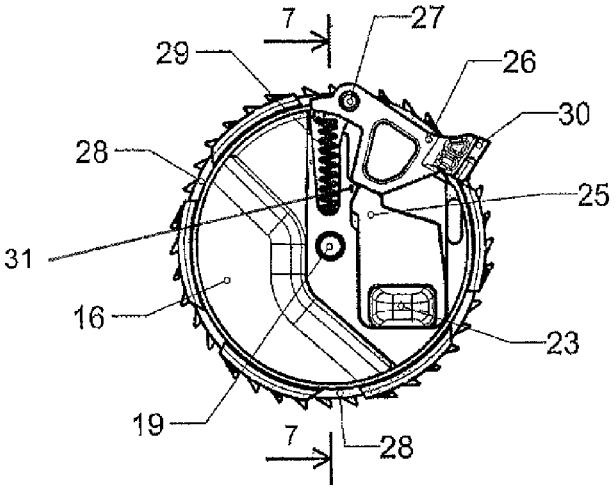
FIG. 4 represents a vertical cross-sectional view of the securing device of FIG. 3, with the selector in the lowered position corresponding to clamp mode.
Figure 7:
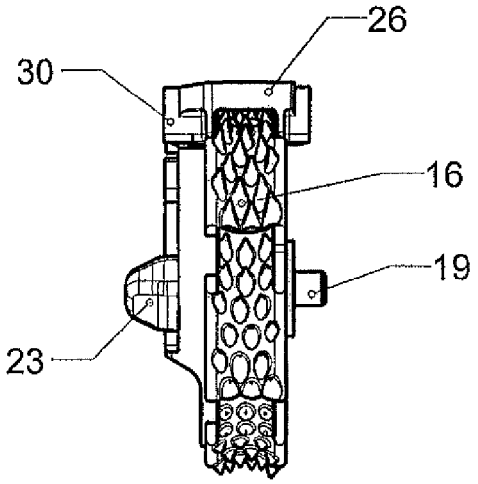
FIGS. 7 and 8 are respective cross-sectional views along the lines 7-7 and 8-8 of FIGS. 4 and 5.

Operation of 10 fall arrest safety apparatus with clamp function is as follows:

FIGS. 4 and 7 show the apparatus in clamp mode. The button of selector 23 is in the lowered position and ratchet 26 is in the active engagement position of stop 30 in two notches 28 of roller 16. Rotation of the latter with respect to arms 17 is then disabled in the descending direction but enabled in the ascending direction. This active position of ratchet 26 is stable in clamp mode due to the pressure exerted by compression spring 29 and the pressing of transmission means 25 and of ratchet 26 on two inclined surfaces of a wedge 31 forming a fixed hang-up point situated on a front arm 17.

Figure 6:
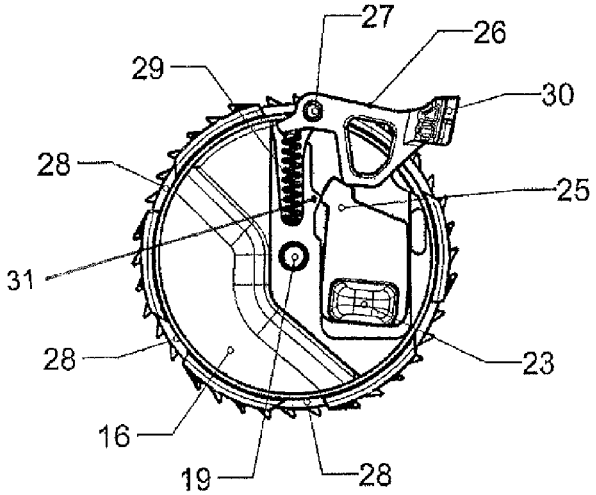
FIG. 6 is an identical view to FIG. 4, in an intermediate position of the selector.

When the button of selector 23 is moved to the raised position to switch to fall arrest mode, transmission means 25 pass over wedge 31 of hang-up point making the button of selector 23 pivot slightly to the intermediate position of FIG. 6. Ratchet 26 pivots in the counterclockwise direction and disengages stop 30 from notches 28.

Figure 5:
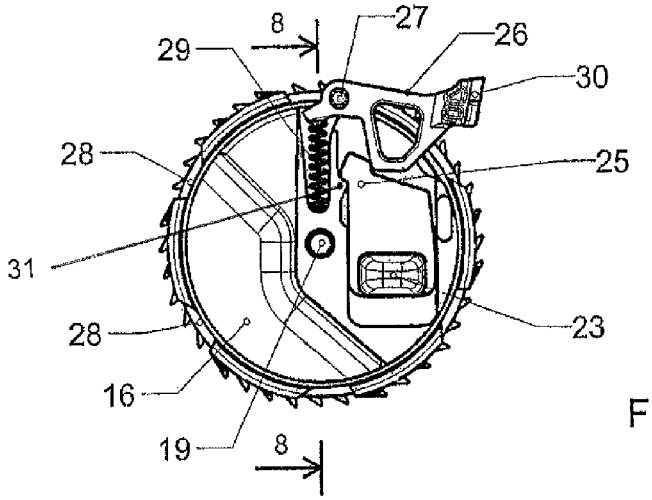
FIG. 5 represents a vertical cross-sectional view of the securing device of FIG. 2, with the selector in the raised position corresponding to fall arrest mode.
Figure 8:
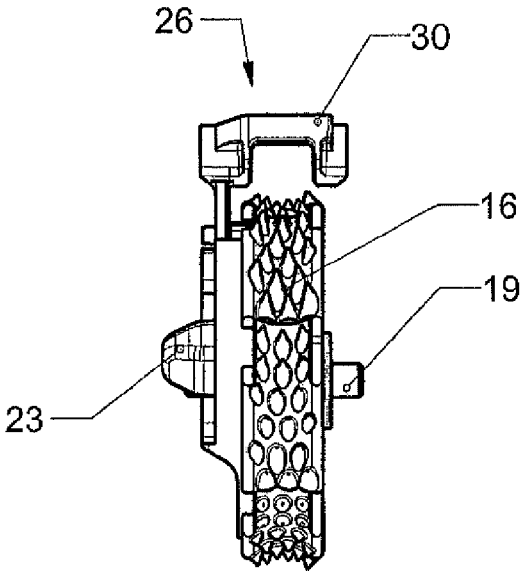

In the raised position of the button, the apparatus is in fall arrest mode (FIGS. 5 and 8). Stop 30 of ratchet 26 is in the inactive position releasing roller 16, which can rotate freely in both directions of rotation, both when ascending and when descending if the centrifugal coupling is in the disengaged state. The inactive position of ratchet 26 is also stable after the hang-up point has been passed, and transmission means 25 are jammed between wedge 31 and ratchet 26. Spring 29 participates in securing ratchet 26 in this position.

The presence of selector 23 enables the user to choose the operating mode of the safety apparatus on a rope, either in fall arrest mode or in clamp mode for self-belaying when ascending. In the fall arrest function, the other clamp function is deactivated. Inversely, in the clamp function, the other fall arrest function is deactivated.

The invention claimed is:

1. A fall arrest safety apparatus, which is movable up and down along a rope during ascending and descending, respectively, for securing a user in all user movements, the fall arrest safety apparatus comprising:

a rigid body provided with a trunking for housing the rope;

a securing system including an articulated support arm and a rotary roller rotatably mounted on the articulated support arm so as to move, according to a speed of rotation of the roller, between a blocking position of the rope in case of a fall and a released position in normal use;

a ratchet mounted on the articulated support arm; and a control selector movable between (i) a first stable position corresponding to a first fall arrest operating mode, and (ii) a second stable position corresponding to a second clamp mode for self-belaying when ascending along the rope, wherein when the control selector is in the first stable position, the control selector remains in the first stable position, and when the control selector is in the second stable position, the control selector remains in the second stable position, in the first stable position, the control selector causes the ratchet to occupy an inactive releasing position enabling the roller to rotate in both directions of rotation, and in the second stable position, the control selector causes the ratchet to occupy an active position ensuring unidirectional blocking rotation of the roller during descending, while permitting rotation of the roller in the ascending direction.

2. The fall arrest safety apparatus according to claim 1, wherein the ratchet is mounted swivelling around a pivot-pin integral to said arm and comprises a stop at one end of the ratchet designed to engage in at least one notch of the roller in the second clamp mode with locking function.

3. The fall arrest safety apparatus according to claim 2, wherein a compression spring acts on a second end of the ratchet to secure the ratchet in a stable manner in each of the active position and the inactive releasing position.

4. The fall arrest safety apparatus according to claim 2, wherein the control selector comprises a button salient from an opening arranged in the articulated support arm, said button being movable in translation between the first position and the second position respectively corresponding to the first fall arrest operating mode and to the second clamp mode.

5. The fall arrest safety apparatus according to claim 4, wherein the button of the control selector is associated with transmission means collaborating with a wedge that forms a hang-up point when the button is in an intermediate position.

6. The fall arrest safety apparatus according to claim 1, wherein the first stable position of the control selector is a mechanically stable position, and the second stable position of the control selector is a mechanically stable position.

7. The fall arrest safety apparatus according to claim 1, wherein the ratchet is stable in the inactive releasing position and in the active position.

8. The fall arrest safety apparatus according to claim 7, wherein movement of the control selector in translation between the first stable position and the second stable position causes the ratchet to pivot between the stable inactive releasing position and the stable active position.

9. The fall arrest safety apparatus according to claim 7, wherein the inactive releasing position of the ratchet is a mechanically stable position, and the active position of the ratchet is a mechanically stable position.

* * * * *